US011257608B2

(12) United States Patent
Tsai et al.

(10) Patent No.: US 11,257,608 B2
(45) Date of Patent: Feb. 22, 2022

(54) CABLE STRUCTURE

(71) Applicant: BELLWETHER ELECTRONIC CORP., Taoyuan (TW)

(72) Inventors: Feng-Jen Tsai, Taoyuan (TW); Yen-Jang Liao, Taoyuan (TW)

(73) Assignee: BELLWETHER ELECTRONIC CORP., Taoyuan (TW)

( * ) Notice: Subject to any disclaimer, the term of this patent is extended or adjusted under 35 U.S.C. 154(b) by 0 days.

(21) Appl. No.: 17/024,708

(22) Filed: Sep. 18, 2020

(65) Prior Publication Data

US 2021/0407704 A1 Dec. 30, 2021

(30) Foreign Application Priority Data

Jun. 24, 2020 (TW) ..... 109121512

(51) Int. Cl.
*H01B 7/08* (2006.01)
*H01B 7/02* (2006.01)
*H01B 3/44* (2006.01)

(52) U.S. Cl.
CPC ..... *H01B 7/0838* (2013.01); *H01B 7/0225* (2013.01); *H01B 3/441* (2013.01); *H01B 7/0861* (2013.01)

(58) Field of Classification Search
CPC .... H01B 7/0838; H01B 7/0225; H01B 3/441; H01B 7/0861
See application file for complete search history.

(56) References Cited

U.S. PATENT DOCUMENTS

| | | | | |
|---|---|---|---|---|
| 7,807,927 | B2 * | 10/2010 | Yeh | H01B 7/0838 174/11 OR |
| 8,669,483 | B2 * | 3/2014 | Shimura | H05K 1/0224 174/350 |
| 2007/0193770 | A1 * | 8/2007 | Ueno | H01B 7/0861 174/117 FF |
| 2010/0044077 | A1 * | 2/2010 | Takamatsu | H01B 3/56 174/25 R |
| 2018/0061530 | A1 * | 3/2018 | Lee | H01B 7/0216 |

FOREIGN PATENT DOCUMENTS

| | | | |
|---|---|---|---|
| CN | 107799225 | A | 3/2018 |
| CN | 110709947 | A | 1/2020 |
| EP | 0778588 | B1 | 9/2004 |
| TW | 200822150 | A | 5/2008 |
| TW | 201119859 | A1 | 6/2011 |
| TW | 201545882 | A | 12/2015 |
| TW | 202004783 | A | 1/2020 |

* cited by examiner

*Primary Examiner* — Pete T Lee
(74) *Attorney, Agent, or Firm* — Li & Cai Intellectual Property Office

(57) ABSTRACT

A cable structure including at least one conductor, a cladding layer, a low dielectric constant (Dk) resin layer, and a shielding layer is provided. The cladding layer includes a low Dk adhesive layer and two insulation layers. The low Dk adhesive layer is coated around the at least one conductor. The two insulation layers respectively are adhered to two opposite surfaces of the low Dk adhesive layer. Each of the low Dk adhesive layers and the two insulation layers has a dielectric constant between 1.3 and 3. The low Dk resin layer is adhered to the cladding layer through a first adhesive layer. The shielding layer is adhered to the low Dk resin layer through a second adhesive layer. The at least one conductor is disposed in the low Dk adhesive layer and positioned between the two insulation layers.

18 Claims, 3 Drawing Sheets

CABLE STRUCTURE

CROSS-REFERENCE TO RELATED PATENT APPLICATION

This application claims the benefit of priority to Taiwan Patent Application No. 109121512, filed on Jun. 24, 2020. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a cable structure, and more particularly to a cable structure that has a high environmental resistance and a low insertion loss.

BACKGROUND OF THE DISCLOSURE

In recent years, consumer electronics such as tablet computers and smartphones have been developed to be mainly thinner and lighter. Flexible flat cables (FFC) are widely used in consumer electronics due to their advantages of being flexible, bendable, small in volume, thin in thickness, and easy in connection. For example, the FFCs can be used as high speed transmission cable structures that transmit signals among electronic devices such as liquid crystal display devices and plasma display devices.

Generally speaking, high-speed data transmission is conducted through a broader bandwidth and a faster speed. The speed of data transmission usually depends on the electrical characteristics of cables. A structure of an FFC mainly includes a plurality of conductors in shapes of flat boards, an insulation layer coated around the outside of the plurality of conductors, and shielding layers that are disposed on two sides of the insulation layer. The aforementioned layers are adhered to each other with adhesives.

However, it is a characteristic of materials composing the cables that they are easily affected by the environment, causing restrictions on the quality of cable transmissions. For example, polyester resin is a material commonly used as an insulation layer of the cables, but under an environment with high temperature and humidity, the polyester resin is easily hydrolyzed, which weakens the bonding strength of the polyester resin and affects the overall structural strength of the cables. In addition, the materials composing the cables are important factors that affect the insertion loss. The insertion loss is a signal power loss caused by the insertion of devices into transmission lines, which is related to the dielectric constant and dissipation factor of the materials composing the transmission lines.

Therefore, it has become an important issue for the industry to effectively reduce the insertion loss of the cables, improve propagation delay and signal integrity under high transmission speed, and strengthen the environmental resistance.

SUMMARY OF THE DISCLOSURE

In response to the above-referenced technical inadequacies, the present disclosure provides a cable structure that has high environmental resistance and low insertion loss.

In one aspect, the present disclosure provides a cable structure including at least one conductor, a cladding layer, two low dielectric constant (Dk) resin layers, and two shielding layers. The cladding layer includes a low Dk adhesive layer and two insulation layers. The low Dk adhesive layer is coated around the at least one conductor. The two insulation layers respectively adhere to two opposite surfaces of the low Dk adhesive layer, and the low Dk adhesive layer and each of the two insulation layers each have a dielectric constant between 1.3 and 3. The two low Dk resin layers are respectively positioned on two outer surfaces of the cladding layer. The two shielding layers are respectively positioned corresponding to an outer surface of each of the two low Dk resin layers. The at least one conductor is disposed in the low Dk adhesive layer and positioned between the two insulation layers.

In another aspect, the present disclosure provides a cable structure including at least one conductor, a cladding layer, two low Dk resin layers, and two shielding layers. The cladding layer includes a plurality of low Dk adhesive layers and a plurality of insulation layers. The cladding layer is divided into a central part and a surrounding part which surrounds the central part. The central part is composed of one of the plurality of low Dk adhesive layers coated around the at least one conductor. The surrounding part is composed of the plurality of insulation layers and the other plurality of low Dk adhesive layers stacked alternatively from the inside to the outside. A volume ratio of the plurality of low Dk adhesive layers to the plurality of cladding layers is between 10 and 90 percent. Each of the plurality of low Dk adhesive layers has a dielectric constant between 1.3 and 3. The two low Dk resin layers are respectively positioned on two outer surfaces of the cladding layer. The two shielding layers are respectively positioned corresponding to an outer surface of each of the two low Dk resin layers.

In another aspect, the present disclosure provides a cable structure including a plurality of conductors, a cladding layer, two low Dk resin layers, and two shielding layers. The cladding layer includes a low dielectric constant (Dk) adhesive layer and two insulation layers. The low Dk adhesive layer is coated around the plurality of conductors. The two insulation layers are respectively adhered to two opposite surfaces of the low Dk adhesive layer. The low Dk adhesive layer and the two insulation layers each have a dielectric constant between 1.3 and 3. The two low Dk resin layers are respectively positioned on two outer surfaces of the cladding layer. The two shielding layers are positioned on corresponding two outer surfaces of the two low Dk resin layers, respectively. Wherein, the conductors include grounding conductors and signal conductors and each two adjacent signal conductors are between two grounding conductors.

One of the advantages of the present disclosure is the cable structure with the high environmental resistance and the low insertion loss. Through changing a material composition of an internal structure of the cable to adjust the physical properties and the electrical characteristics of the cable structure, the cable structure of the present disclosure having at least one conductor has strengthened environmental resistance, and reduced energy loss and propagation delay of signals.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
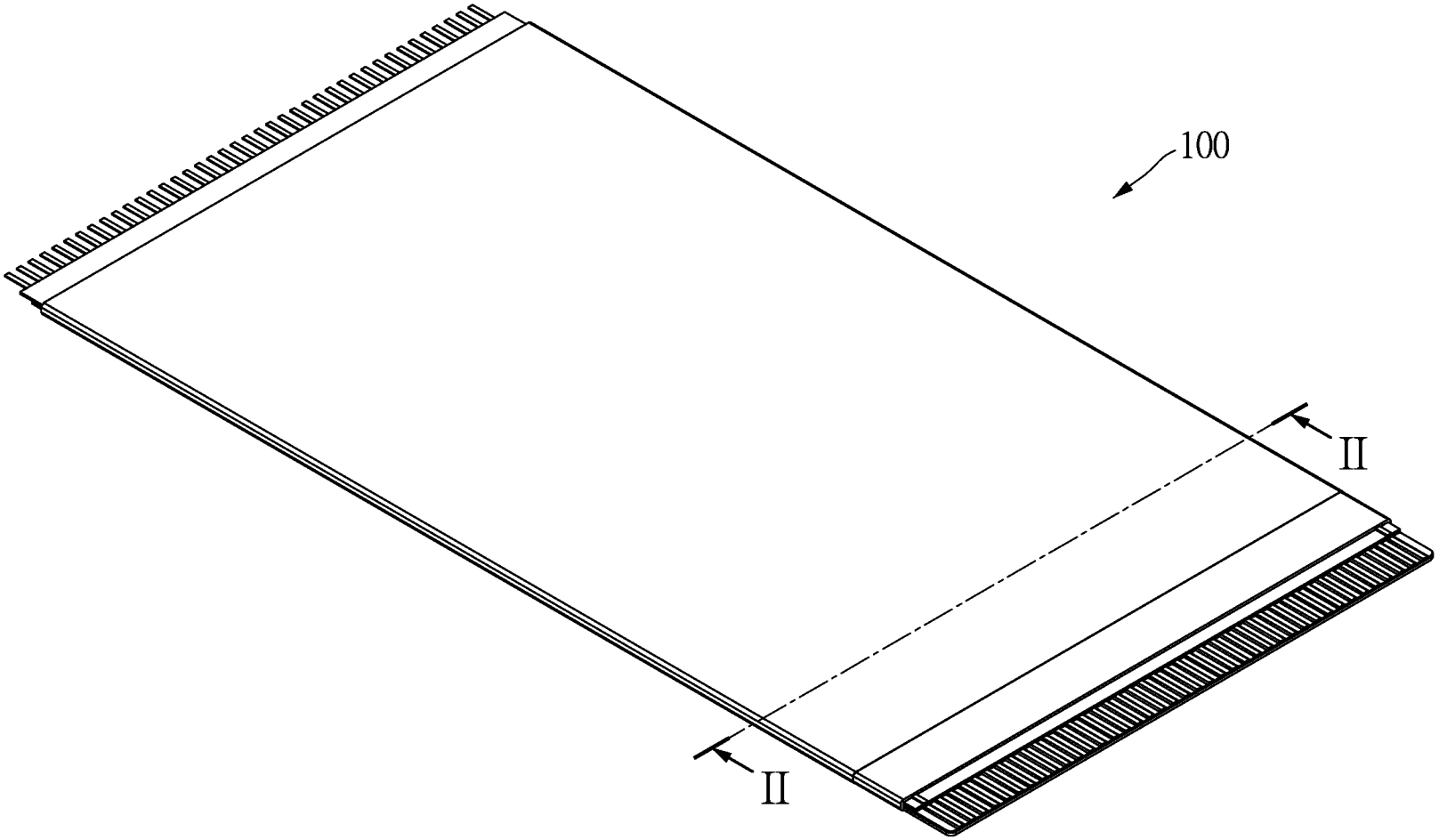
FIG. 1 is a schematic perspective view of a cable structure of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Figure 2:
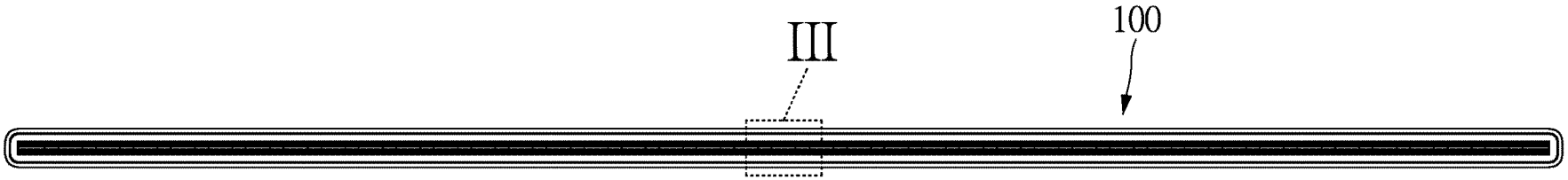
FIG. 2 is a cross-sectional view taken along line II-II of FIG. 1.
Figure 3:
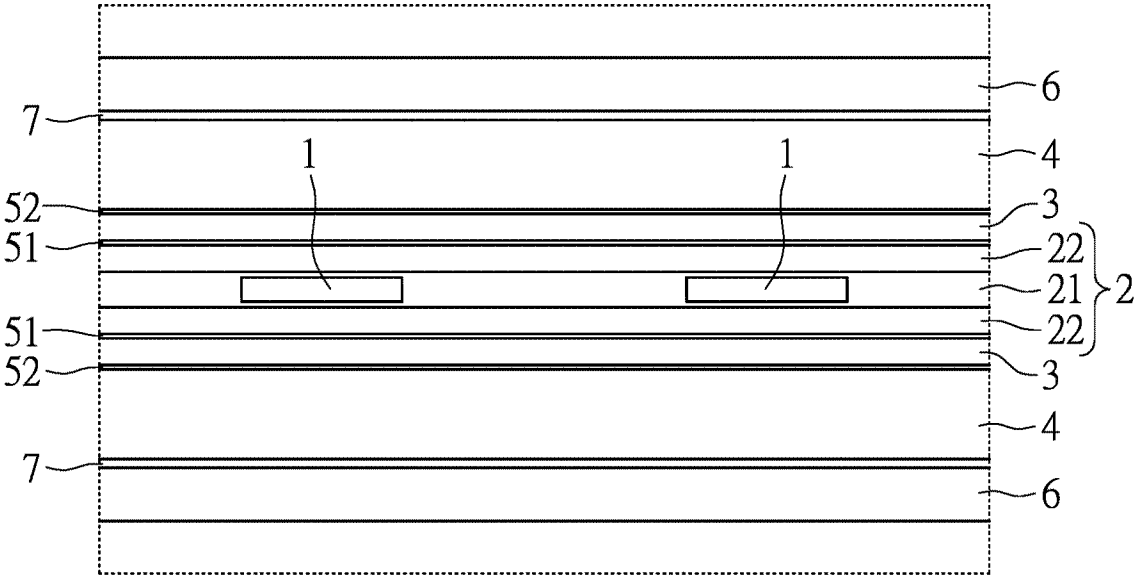
FIG. 3 shows an enlarged view of part III of FIG. 2.

FIG. 1 is a schematic perspective view of a cable structure of the present disclosure. The present disclosure mainly provides a cable structure 100, which is a flexible flat cable (FFC). FIG. 2 is a cross-sectional view taken along line II-II of FIG. 1. FIG. 3 shows an enlarged view of part III of FIG. 2. FIG. 2 and FIG. 3 further show an internal structure of the cable structure 100 of the present disclosure. The internal structure of the cable structure 100 mainly includes at least one conductor 1, a cladding layer 2, two low dielectric constant (Dk) resin layers 3, and two shielding layers 4.

In general, the cable structure 100 includes a plurality of conductors 1, i.e., a plurality of grounding conductors and a plurality of signal conductors. Each two of the plurality of signal conductors are disposed adjacent to each other and are disposed between two of the plurality of grounding conductors, and the two outermost ones of the plurality of conductors are grounding conductors. The plurality of grounding conductors is grounded. Each two of the plurality of signal conductors that are disposed adjacent to each other are respectively transmitted with two signals of differential pair. The plurality of grounding conductors may be electrically connected with the shielding layers 4.

The cladding layer 2 includes a low Dk adhesive layer 21 and two insulation layers 22. The at least one conductor 1 is disposed in the low Dk adhesive layer 21 and positioned between the two insulation layers 22.

Specifically speaking, the low Dk adhesive layer 21 is coated around the at least one conductor 1, and the two insulation layers 22 are respectively positioned on two opposite sides of the low Dk adhesive layer 21. The two low Dk resin layers 3 are respectively positioned on two outer surfaces of the cladding layer 2. The two shielding layers 4 are respectively positioned corresponding to an outer surface of each of the two low Dk resin layers 3.

The processing procedure of the cable structure 100 is described in the following. First of all, a low Dk adhesive layer 21 and an insulation layer 22 are disposed on each side of the at least one conductor 1 respectively, and each of the low Dk adhesive layers 21 on each side is facing toward the at least one conductor 1. Secondly, the at least one conductor 1, the low Dk adhesive layer 21, and the insulation layer 22 on each side are proceeded with a lamination process through rollers. During the lamination process, the low Dk adhesive layer 21 on both an upper side and a lower side of the at least one conductor 1 are adhered to each other and form a single layer of the low Dk adhesive layer 21, coated around so as to encapsulate the at least one conductor 1 inside the single layer of the low Dk adhesive layer 21. Afterward, the two insulation layers 22 and the single layer of low Dk adhesive layer 21 therebetween compose the cladding layer 2. Subsequently, the two low Dk resin layers 3 respectively are adhered to the two outer surfaces of the cladding layer 2 through two first adhesive layers 51 and the two shielding layers 4 respectively are adhered to the two outer surfaces of the two low Dk resin layers 3 through two second adhesive layers 52.

It is worth mentioning that, the cladding layer 2 is a composite layer, which indicates that the cladding layer 2 is not limited to be composed of the single layer of low Dk adhesive layer 21 and the two insulation layers 22. In another embodiment of the present disclosure, the cladding layer 2 can include a plurality of low Dk adhesive layers 21 and a plurality of insulation layers 22. To be more specific, the cladding layer 2 can be divided into a central part and a surrounding part which surrounds the central part. The central part is composed of one of the plurality of low Dk adhesive layers 21 coated around the at least one conductor 1. The surrounding part is composed of the plurality of insulation layers 22 and the other plurality of low Dk adhesive layers 21 stacked alternatively from the inside to the outside of the cable structure 100. That is to say, at least one insulation layer 22 and at least one low Dk adhesive layer 21 are stacked alternatively on an upper side of the one of the plurality of low Dk adhesive layers 21 in the central part, and at least one insulation layer 22 and at least one low Dk adhesive layer 21 are stacked alternatively on a lower side of the one of the plurality of low Dk adhesive layers 21 in the central part.

Moreover, detailed descriptions of the electrical characteristics, the physical properties, and the material composition of the cable structure 100 are conveyed in the following. Each of the plurality of low Dk adhesive layers 21 is composed of adhesive compositions with low dielectric losses. The at least one conductor 1 can be composed of conductive metal foils (e.g., copper foils, tinned soft copper foils, etc.). The at least one conductor 1 is in the shape of a strip, and has a quantity of one or more. During processing, one of the plurality of low Dk adhesive layers 21 is in fluid form and injected among the at least one conductor 1.

In the present disclosure, a thickness of each of the plurality of low Dk adhesive layers 21 is preferably 10 μm to 150 μm, and a thickness of each of the plurality of insulation layers 22 is preferably 10 μm to 200 μm. In the present disclosure, a volume ratio of the plurality of low Dk adhesive layers 21 to the cladding layer 2 is between 10% and 90%. In the most preferred embodiment of the present disclosure, the thickness of each of the plurality of low Dk adhesive layers 21 is 60 μm to 100 μm, and the thickness of each of the plurality of insulation layers 22 is 120 μm to 130 μm.

Each of the plurality of low Dk adhesive layers 21 has a characteristic of having a low dielectric loss. In the present disclosure, each of the plurality of low Dk adhesive layers 21 has a preferred Dk between 1.3 and 3, and a preferred dissipation factor (Df) between 0.0001 and 0.01. In the most preferred embodiment of the present disclosure, when the cable structure 100 has a transmission frequency of 10 GHz, each of the plurality of low Dk adhesive layers 21 has a dielectric constant of 2.25, and a dissipation factor of 0.0004 substantially.

Each of the plurality of insulation layers 22 also has a preferred Dk between 1.3 and 3, and a preferred Df between 0.0001 and 0.01. To be more specific, when the cable structure 100 has a transmission frequency of 10 GHz, each of the plurality of insulation layers 22 has a most preferred dielectric constant of 2.08 substantially, and a most preferred dissipation factor of 0.0006 substantially.

In the present disclosure, each of the plurality of low Dk adhesive layers 21 has a melting point between 60 ° C. and 350 ° C., and each of the plurality of insulation layers 22 also has a melting point between 60 ° C. and 350 ° C. In a preferred embodiment of the present disclosure, each of the plurality of low Dk adhesive layers 21 has a melting point between 60 ° C. and 130 ° C., and each of the plurality of insulation layers 22 has a melting point between 150 ° C. and 250 ° C. To be more specific, in the most preferred embodiment of the present disclosure, each of the plurality of low Dk adhesive layers 21 has a melting point between 70 ° C. and 80-° C., and each of the plurality of insulation layers 22 has a melting point of 230 ° C. When each of the plurality of insulation layers 22 has a melting point (preferably more than 20 ° C.) higher than that of each of the plurality of low Dk adhesive layers 21, an operating temperature of the lamination process can be controlled to be simultaneously above the melting point of each of the plurality of low Dk adhesive layers 21 and below the melting point of each of the plurality of insulation layers 22, so as to avoid the issue that the operating temperature easily exceeds the melting point of each of the plurality of low Dk adhesive layers 21 and each of the plurality of insulation layers 22 at the same time, resulting in processing difficulty or deterioration of each of the plurality of insulation layers 22.

In the present disclosure, each of the plurality of low Dk adhesive layers 21 has a water absorption rate between 0.001% and 1%, and each of the plurality of insulation layers 22 also has a water absorption rate between 0.001% and 1%. To be more specific, in the most preferred embodiment of the present disclosure, the absorption rate of each of the plurality of low Dk adhesive layers 21 is less than 0.01% and the water absorption rate of each of the plurality of insulation layers 22 is also less than 0.01%.

As mentioned above, in another embodiment of the present disclosure, since the cladding layer 2 is a composite layer, the cladding layer 2 can be composed of at least one low Dk adhesive layer 21 and at least two insulation layers 22, one of the at least one low Dk adhesive layer 21 is coated around the at least one conductor 1, and rest of the at least one low Dk adhesive layer 21 and the at least two insulation layers 22 are stacked alternatively outside of the at least one low Dk adhesive layer 21 coated around the at least one conductor 1. Therefore, the physical properties and the electrical characteristics of the cladding layer 2, such as the thickness, the dielectric constant, and the dissipation factor are essentially subjected to the composition ratio of the at least one low Dk adhesive layer 21 and the at least two insulation layers 22. In the present disclosure, the volume ratio between the at least one low Dk adhesive layer 21 and the cladding layer 2 is between 10% and 90%, which indicates a volume of the at least one low Dk adhesive layer 21 is 10% to 90% of a volume of the cladding layer 2. In the most preferred embodiment of the present disclosure, the cladding layer 2 has a most preferred thickness between 180 μm and 230 μm, and the cladding layer 2 has a most preferred dielectric constant of 2.16 and a dissipation factor of 0.0004.

Figure 4:
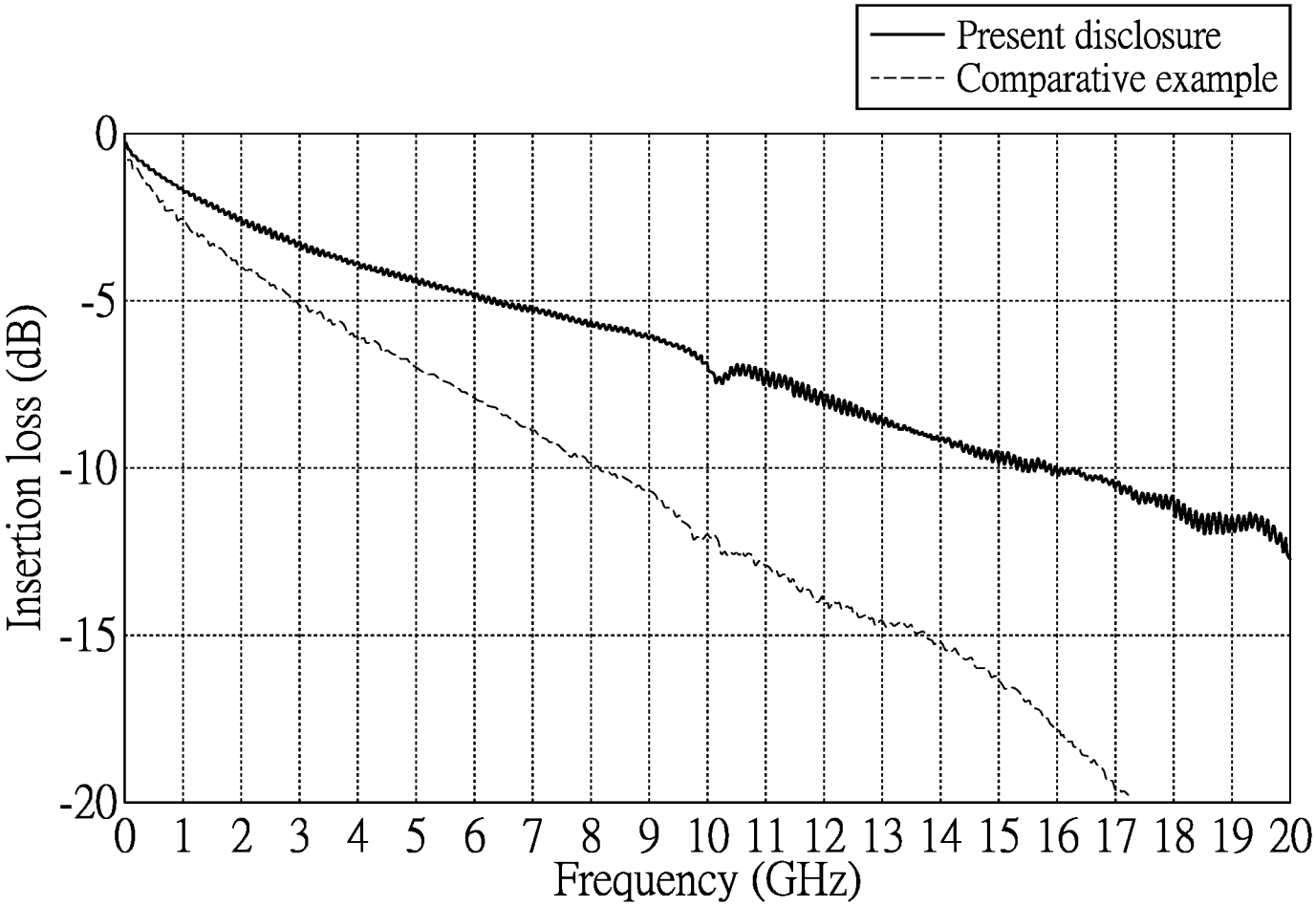
FIG. 4 is a correlation curve between an insertion loss and a frequency of a cladding layer of the cable structure of the present disclosure.

Reference is made to FIG. 4, which is a correlation curve between an insertion loss and a frequency of the cladding layer of the cable structure of the present disclosure. An X-axis is a signal frequency of a transmission of the cable, and a Y-axis is an insertion loss. As shown FIG. 4, in a comparative example, the cladding layer 2 is under a condition where a thickness is 125μm, a dielectric constant is 2.1, and a loss factor is 0.0004. In the present disclosure, the cladding layer 2 is under a condition where a thickness is 180 μm, a dielectric constant is 2.16, and a dissipation factor is 0.0004. As shown in FIG. 4, in the present disclosure, under a condition that the frequency is at 8 GHz, a transmission loss (which is the insertion loss) is −5.63 dB, which is less than that in the comparative example, which is −9.83 dB. When the cladding layer 2 in the present disclosure is under the most preferred condition (the thickness being 180 μm to 230 μm, the dielectric constant being 2.16, and the dissipation factor being 0.0004), with the increase of the frequency, the dielectric loss of the material also increases. Therefore, decreasing the dielectric constant is effective in improving the propagation delay and the signal integrity in a high frequency transmission.

According to the above, the low Dk adhesive layer 21 is composed of adhesive compositions with low dielectric losses. Preferably, the low Dk adhesive layer 21 is selected from the group consisting of polyester, polyimide, fluoropolymer, liquid crystal polymer, polyolefin, polyether, polysulfide, polystyrene, bismaleimide, and bismaleimide-triazine resin. To be more specific, in the most preferred embodiment of the present disclosure, the low Dk adhesive layer 21 is composed of polyolefin hot melt adhesive, and has a dielectric constant of 2.25 and a dissipation factor of 0.0004.

It is worth mentioning that, according to practical requirements, the aforementioned adhesive compositions can further include at least one of the following additives: hardening accelerator, solvent, cross-linking agent, coupling agent, interface active agent, toughening agent, inorganic filler or a combination thereof. The abovementioned ingredients are all commercially available, or can be obtained through a conventional method that is ordinary in the art. Unless otherwise defined or described, all professional and scientific terms used in this article have the same meaning as people that are ordinarily skilled in the art. Moreover, any method and materials similar or equivalent to the content can be applied to the adhesive compositions.

In the present disclosure, an insulation layer 22 is selected from the group consisting of polyester, polyimide, fluoropolymer, liquid crystal polymer, polyolefin, polyether, polysulfide, polystyrene, bismaleimide, and bismaleimide-triazine resin. To be more specific, in the most preferred embodiment of the present disclosure, the insulation layer 22 is composed of composite materials containing high melt strength polyolefin, and has a dielectric constant of 2.08, a dissipation factor of 0.0006, and a melting point of 230 ° C.

The two low Dk resin layers 3 are characterized in having a low Dk, superior flexibility, and processability, which can be composed of a material such as polyolefin. Moreover, a fire retardant may be added into the two low Dk resin layers 3 for enhancing the flame resistance.

The two shielding layers 4 are characterized in reducing the electromagnetic interference and signal noises, and the two shielding layers 4 may be thin metal layers, which may be composed of materials such as copper, aluminum, and silver or combination thereof, but the present disclosure is not limited thereto.

The two first adhesive layers 51 and the two second adhesive layers 52 are composed of adhesive compositions with low dielectric losses. The aforementioned adhesive compositions, according to practical requirements, can further include at least one of the following additives: hardening accelerator, solvent, cross-linking agent, coupling agent, interface active agent, toughening agent, inorganic filler or a combination thereof. The abovementioned ingredients are all commercially available, or can be obtained through a conventional method that is ordinary in the art. Unless otherwise defined or described, all professional and scientific terms used in this article have the same meaning as people that are ordinarily skilled in the art. Moreover, any method and material similar or equivalent to the content can be applied to the adhesive compositions.

Referring to FIG. 3, the cable structure 100 of the present disclosure may further include two protective layers 6 that respectively cover the two outer surfaces of the two shielding layers 4, so as to enhance the overall safety of the cable. Specifically speaking, the two protective layers 6 are adhered to corresponding outer surfaces of the two shielding layers 4 through two third adhesive layers 7 respectively. The two third adhesive layers 7 can be composed of general adhesive composition materials, such as adhesives that are the same as that of the two second adhesive layers 52. The two protective layers 6 may be insulation materials that are thermoplastic or thermosetting.

One of the advantages of the present disclosure is that the cable structure 100 has the characteristic of the low dielectric constant and the low dissipation factor by the cladding layer 2 composed of the at least one low Dk adhesive layer 21 and the at least two insulation layers 22.

According to the above, during the manufacturing process of the cable structure 100, the low Dk adhesive layer 21 is required to clad around the at least one conductor 1, and the two insulation layers 22 then respectively adhere to the two opposite surfaces of the low Dk adhesive layer 21. The low Dk adhesive layer 21 is mainly composed of a polyolefin material. Since the aforementioned polyolefin material has a lower melting point, the required temperature (the temperature that makes the polyolefin material into a molten state) of the lamination process is lower. In other words, the amount of energy consumed in the manufacturing process is also lower.

Furthermore, the insulation layer 22 is composed of composite materials containing polyolefin. Polyolefin materials have poor water absorption, thus have better tolerance under a high temperature and high humidity environment, and the insulation layer 22 thereby being less likely to be hydrolyzed due to the high humidity of the environment. In other words, the cable structure 100 provided by the present disclosure has a better applicability toward different environments than the conventional cable structures, which is able to maintain the overall structural strength under the high temperature and high humidity environment.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A cable structure, comprising:

at least one conductor;

a cladding layer including a low dielectric constant (Dk) adhesive layer and two insulation layers, the low Dk adhesive layer being coated around the at least one conductor, the two insulation layers respectively being adhered to two opposite surfaces of the low Dk adhesive layer, and the low Dk adhesive layer and the two insulation layers each having a dielectric constant between 1.3 and 3;

two low Dk resin layers respectively positioned on two outer surfaces of the cladding layer; and two shielding layers positioned on corresponding two outer surfaces of the two low Dk resin layers, respectively;

wherein the at least one conductor is disposed in the low Dk adhesive layer and positioned between the two insulation layers;

wherein a melting point of each of the two insulation layers is higher than a melting point of the low Dk adhesive layer.

2. The cable structure according to claim 1, wherein each of the low Dk adhesive layer and the two insulation layers has a dissipation factor between 0.0001 and 0.01.

3. The cable structure according to claim 1, wherein the low Dk adhesive layer is selected from the group consisting of polyester, polyimide, fluoropolymer, polyolefin, polyamide, polyurethane, epoxy resin, thermoplastic rubber, ethylene-vinyl acetate copolymer, and polyvinyl alcohol.

4. The cable structure according to claim 1, wherein the low Dk adhesive layer is composed of a polyolefin hot melt adhesive.

5. The cable structure according to claim 1, wherein each of the two insulation layers is selected from the group consisting of polyester, polyimide, fluoropolymer, liquid crystal polymer, polyolefin, polyether, polysulfide, polystyrene, bismaleimide, and bismaleimide-triazine resin.

6. The cable structure according to claim 1, wherein the two insulation layers are composed of composite materials containing high melt strength polyolefin.

7. The cable structure according to claim 1, wherein the melting point of each of the two insulation layers is between 150 ° C. and 250° C.

8. The cable structure according to claim 1, wherein an absorption rate of each of the two insulation layers is less than 0.1%.

9. A cable structure, comprising:

at least one conductor;

a cladding layer including a plurality of low dielectric constant (Dk) adhesive layers and a plurality of insulation layers, the cladding layer being divided into a central part and a surrounding part which surrounds the central part, the central part being composed of one of the plurality of low Dk adhesive layers being coated around the at least one conductor, the surrounding part being composed of the plurality of insulation layers and other plurality of low Dk adhesive layers stacked alternatively from the inside to the outside, a volume ratio of the plurality of low Dk layers to the cladding layer is between 10 and 90 percent, and the low Dk adhesive layer has a dielectric constant between 1.3 and 3;

two low Dk resin layers respectively positioned on two outer surfaces of the cladding layer; and two shielding layers positioned on corresponding two outer surfaces of the two low Dk resin layers, respectively.

10. The cable structure according to claim 9, wherein each of the plurality of low Dk adhesive layers has a dissipation factor between 0.0001 and 0.01.

11. The cable structure according to claim 9, wherein a melting point of each of the plurality of insulation layers is higher than a melting point of the plurality of low Dk adhesive layers.

12. The cable structure according to claim 11, wherein the melting point of each of the plurality of low Dk adhesive layers is between 60° C. and 130 ° C.

13. The cable structure according to claim 11, wherein the melting point of each of the plurality of insulation layers is between 150 degrees ° C. and 250 ° C.

14. The cable structure according to claim 9, wherein an absorption rate of each of the plurality of insulation layers is less than 0.1%.

15. The cable structure according to claim 9, wherein each of the plurality of insulation layers is selected from the group consisting of polyester, polyimide, fluoropolymer, liquid crystal polymer, polyolefin, polyether, polysulfide, polystyrene, bismaleimide, and bismaleimide-triazine resin.

16. A cable structure, comprising:

a plurality of conductors;

a cladding layer including a low dielectric constant (Dk) adhesive layer and two insulation layers, the low Dk adhesive layer being coated around the plurality of conductors, the two insulation layers respectively being adhered to two opposite surfaces of the low Dk adhesive layer, and the low Dk adhesive layer and the two insulation layers each having a dielectric constant between 1.3 and 3;

two low Dk resin layers respectively positioned on two outer surfaces of the cladding layer; and two shielding layers positioned on corresponding two outer surfaces of the two low Dk resin layers, respectively;

wherein the plurality of conductors includes a plurality of grounding conductors and a plurality of signal conductors and each two of the plurality of signal conductors are disposed adjacent to each other and are disposed between two of the plurality of grounding conductors;

wherein a melting point of each of the two insulation layers is higher than a melting point of the low Dk adhesive layer.

17. The cable structure according to claim 16, wherein the low Dk adhesive layer is selected from the group consisting of polyester, polyimide, fluoropolymer, polyolefin, polyamide, polyurethane, epoxy resin, thermoplastic rubber, ethylene-vinyl acetate copolymer, and polyvinyl alcohol.

18. The cable structure according to claim 16, wherein each of the two insulation layers is selected from the group consisting of polyester, polyimide, fluoropolymer, liquid crystal polymer, polyolefin, polyether, polysulfide, polystyrene, bismaleimide, and bismaleimide-triazine resin.

* * * * *